US005628134A

United States Patent [19]

Wesp et al.

[11] Patent Number: 5,628,134

[45] Date of Patent: May 13, 1997

[54] MAGAZINE RETAINER FOR A HAND FIREARM

[75] Inventors: Horst Wesp; Peter Dallhammer, both of Ulm, Germany

[73] Assignee: Carl Walther GmbH, Ulm, Germany

[21] Appl. No.: 604,338

[22] Filed: Feb. 21, 1996

[30] Foreign Application Priority Data

Mar. 1, 1995 [DE] Germany ..... 195 07 012.7

[51] Int. Cl.[6] ..... F41A 9/65

[52] U.S. Cl. ..... 42/7; 42/50

[58] Field of Search ..... 42/7, 50, 70.07, 42/70.02

[56] References Cited

U.S. PATENT DOCUMENTS

| | | | |
|---|---|---|---|
| 3,715,826 | 2/1973 | Seifried | 42/70.02 |
| 4,326,353 | 4/1982 | Ludwig et al. | 42/7 |
| 4,638,581 | 1/1987 | Moore | 42/7 |
| 4,768,301 | 9/1988 | Thomas | 42/7 |
| 4,798,018 | 1/1989 | Johansson | 42/7 |
| 4,835,892 | 6/1989 | Ruger et al. | 42/7 |

FOREIGN PATENT DOCUMENTS

| | | | |
|---|---|---|---|
| 593956 | 3/1932 | Germany | 42/70.02 |
| 587871 | 11/1933 | Germany | 42/70.02 |
| 2618074 | 11/1977 | Germany | 42/7 |

*Primary Examiner*—Stephen M. Johnson
*Attorney, Agent, or Firm*—Edmund M. Jaskiewicz

[57] ABSTRACT

A magazine retainer that is actuable on both sides of an automatic pistol is mounted to pivot in a recess of the stock of the pistol. The recess or the magazine retainer is molded during the injection molding of the stock. The magazine retainer is provided with two lateral actuation plates which are positioned in openings on both sides of the rear portion of the trigger guard and these trigger guard openings have a depth which corresponds to the thickness of the actuation plates. Accordingly, the outer surfaces of the actuation plates conform smoothly with the outer surface of the firearm and there are no projecting portions thereof in the area where the trigger guard merges with the pistol stock.

4 Claims, 1 Drawing Sheet

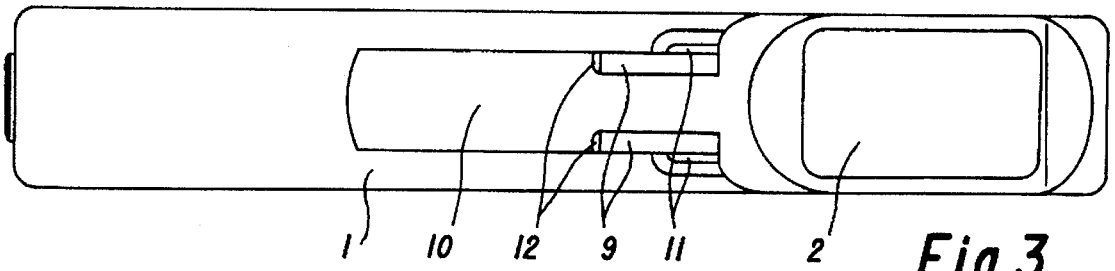
Fig.3
Fig.1
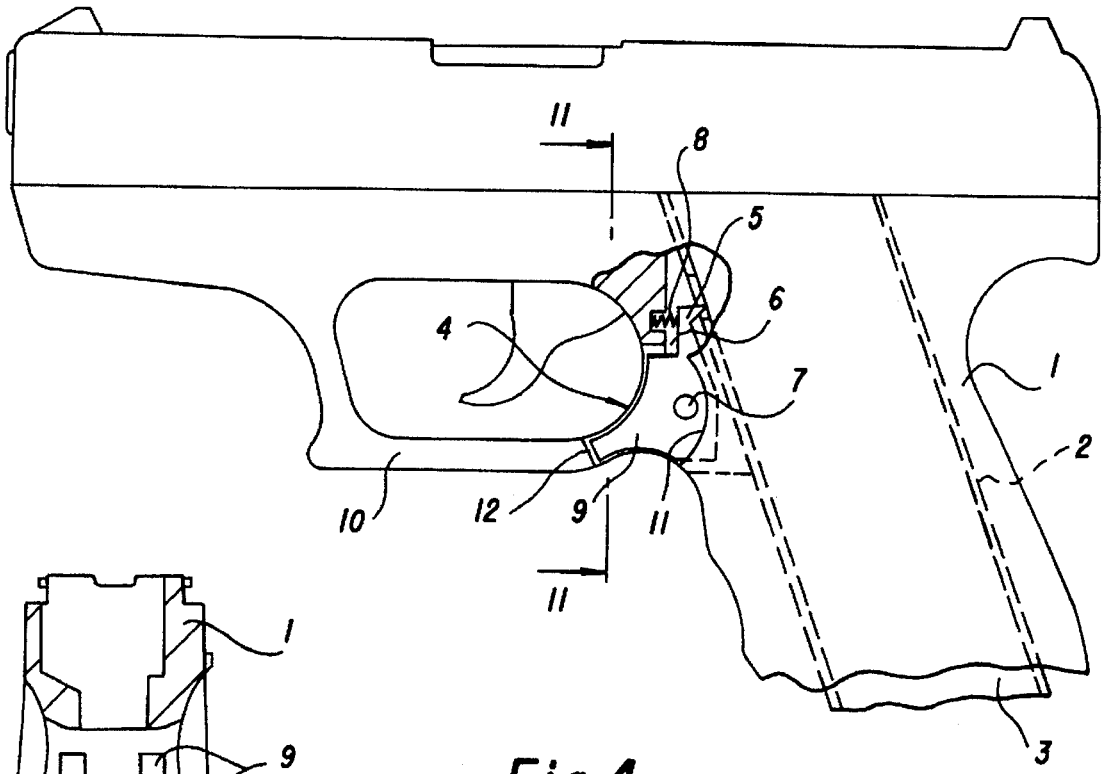
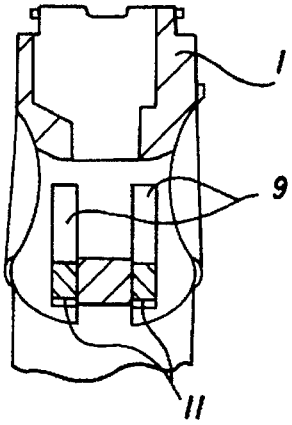
Fig.2
Fig.4
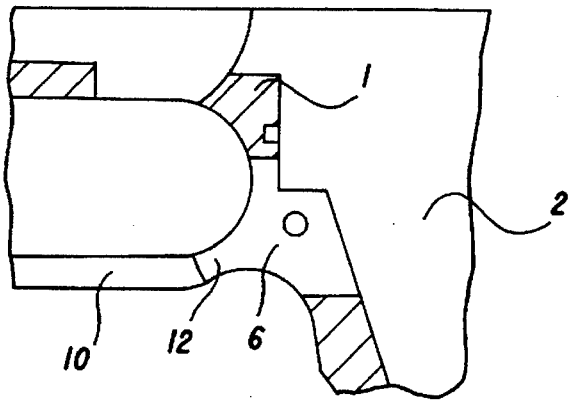

MAGAZINE RETAINER FOR A HAND FIREARM

FIELD OF ART

The present invention relates to hand firearms of the automatic pistol type, more particularly, to a magazine retainer for securing the magazine within the magazine chamber of the pistol stock of such a firearm.

BACKGROUND OF THE INVENTION

In the German patent publication DE-PS 29 05 770, there is disclosed a magazine retainer which is pivotally mounted in a milled-out notch in the stock of the weapon so as to pivot around a horizontal axis disposed transversely to the firing direction of the firearm. The magazine retainer is spring loaded and is provided with a nose portion which is engageable with a catch in the magazine in order to lock the magazine within the magazine chamber in the pistol stock. The magazine retainer extends outwardly on both sides of the pistol stock and is provided with actuation plates on both sides thereof so that the magazine retainer can be actuated by either right-handed or left-handed persons handling the firearm. The actuation plate is pressed forward by the thumb of the shooting hand to cause pivoting of the magazine retainer and to thus disengage the nose from the magazine catch so that the magazine is then free to fall downwardly out of the magazine chamber.

However, this known magazine retainer has the disadvantage that both actuation plates project outwardly beyond the lateral surfaces of the pistol. As a result, there is the ever present danger that the projecting actuation plate of the pistol may be inadvertently caught by the holster, for example, when the pistol is being taken from or put back into the holster. Further, because of the outwardly projecting actuation plates, an undesired release of the magazine can occur under various other circumstances independent of removal from or placing back the pistol in a holster.

SUMMARY OF THE INVENTION

It is therefore the principal object of the present invention to provide a novel and improved magazine retainer for a hand firearm which provides safe and problem-free actuation or release of the magazine lock.

It is another object of the present invention to provide such a magazine retainer having actuating members on both sides of the trigger guard and having their outer surfaces flush with the outer surface of the firearm.

It is a further object of the present invention to provide such a magazine retainer which can be readily actuated by the thumb of either a left-handed or right-handed shooter to lock or release the magazine.

The objects of the present invention are achieved and the disadvantages of the prior art are overcome by providing a magazine retainer for a hand firearm according to the present invention wherein the actuation members of the retainer have their outer surfaces flush with the respective outer surfaces of the firearm.

According to one aspect of the present invention, such a magazine retainer for a hand firearm is pivotally mounted at the merging of the trigger guard and pistol stock and comprises a nose which is engageable with a magazine within a magazine chamber. Further, the actuation members of the magazine retainer each has an outer surface which is flush with the outer surface of the firearm. The actuation members may comprise a pair of spaced actuation plates which are disposed at both sides of the trigger guards within recesses formed in the rear portion of the trigger guard and the pistol stock. The entire magazine retainer including the actuation plates and the nose may comprise a single integral member suitably molded from a plastic. In addition, the retainer member may have a bearing pin molded thereto and received by a snap connection into correspondingly shaped notches in the pistol stock. It is also possible to provide that the pistol stock is molded from a plastic material and the magazine retainer can be molded to the stock.

BRIEF DESCRIPTION OF THE DRAWINGS

Other objects and advantages of the present invention will be apparent upon reference to the accompanying description when taken in conjunction with the following drawings, which are exemplary, wherein;

FIG. 1 is a side elevational view of an automatic pistol incorporating a magazine retainer according to the present invention with portions of this view being in cross section;

FIG. 2 is a sectional view taken along the line II—II in FIG. 1;

FIG. 3 is a bottom plan view of the automatic pistol as shown in FIG. 1; and

FIG. 4 is a partial longitudinal sectional view through the pistol stock and a portion of the trigger guard of FIG. 1 but without the magazine retainer.

DESCRIPTION OF THE PREFERRED EMBODIMENTS

Proceeding next to the drawings wherein like reference symbols indicate the same parts throughout the various views a specific embodiment and modifications of the present invention will be described in detail.

In FIG. 1 there is shown an automatic pistol incorporating the present invention and comprising a pistol stock 1 in which is provided a magazine chamber 2 to receive a magazine 3 of cartridges. In order to lock the magazine 3 in position, a magazine retainer 4 is provided that has a nose 5 which engages into a suitable catch or notch formed in the magazine 3 as seen in FIG. 1. The magazine retainer 4 is positioned in a recess 6 formed in the stock 1 and mounted upon a bearing pin 7 so as to be pivotable around a horizontal axis that is positioned transversely to the firing direction of the firearm. Preferably, the recess 6 in the pistol stock 1 is molded in position during the injection molding of the pistol stock and requires no further machining or finishing (see FIG. 4). A spring 8 is also positioned in the recess 6 and engages the magazine retainer 4 to maintain the retainer in the locked position as shown in FIG. 1.

The magazine retainer 4 is provided with an actuation element which comprises left and right actuation plates 9 which are also formed in the same manner as the nose 5 so as to be integral with the magazine retainer 4. In that area of the firearm wherein the pistol stock 1 merges with the rear portion of a trigger guard 10, there is provided an opening 11 for each of the actuation plates 9 and the openings 11 lead to and communicate with the recess 6. Both of the openings 11 are also formed in the same manner as the recess 6 during the injection molding of the stock 1.

During assembly, the magazine retainer 4 is inserted upwardly through the empty magazine chamber 2 into the recess 6 and then pushed outwardly such that the actuation plates 9 are disposed into the openings 11 in such a manner that the actuation plates extend on both sides of the pistol as shown in FIGS. 2 and 3.

The openings 11 in pistol stock 1 are so positioned that the actuation plates 9 which project up into the area of the trigger guard 10 have their outer surfaces flush with the outer contour surface of the trigger guard 10. In order to accommodate the actuation plates 9, the trigger guard 10 has lateral recesses 12 on each side thereof and the depths of these recesses correspond to the thickness of the respective actuation plates. Further, the outer profile shape of the actuation plates 9 conforms to the contours of the pistol stock 1 at that position of the firearm where the rear portion of the trigger guard merges with the pistol stock 1. The result is a smooth, comfortable and suitable integration of the actuation plates 9 and the outer contour of the pistol.

The outer surfaces of the actuation plate may also be provided with raised portions to be engageable by the thumb of the user when gripping the pistol such that the user merely uses his thumb to push the actuation plate forward to release or unlock the magazine from the magazine retainer nose 5.

In a modification of the present invention, the bearing pin 7 may be formed integrally with the magazine retainer 4. During assembly, the magazine retainer 4 is similarly inserted into the empty magazine chamber 2 and the actuation plates 9 are pushed through and into the openings 11. During this procedure, both ends of the bearing pin 7 will be pressed by a snap action into corresponding plastic notches or holders formed in the interior of the stock 1. These plastic notches or holders which may have the general shape of semi-cylindrical bearings may be molded into the pistol stock 1 which is also formed of plastic.

As a result of the present invention, it is readily apparent that because of the integration of the magazine retainer into the outer surfaces of the pistol stock in such a manner that the surfaces of the magazine retainer are flush and smoothly blend with the surfaces of the pistol stock, any projecting portions of the magazine retailer are eliminated. Thus, any obstructions or hinderances from projecting parts during the handling of the pistol are precluded and operational safety is significantly increased. Further, the relatively simple design and construction of the magazine retainer according to the present invention makes possible a very economical manufacturing procedure and greatly facilitates assembly of the firearm.

It will be understood that this invention is susceptible to modification in order to adapt it to different usages and conditions, and accordingly, it is desired to comprehend such modifications within this invention as may fall within the scope of the appended claims.

What is claimed is:

1. A magazine retainer for a hand firearm having a pistol stock, a trigger guard having a rear portion merging into the pistol stock and there being a magazine chamber in the stock to receive a magazine, said magazine retainer comprising an integral double-arm lever disposed in a first recess in said pistol stock and pivotally mounted around an axis disposed transversely to the firing direction of the firearm, said magazine retainer having upper and lower portions and comprising a nose on said upper portion engageable with a magazine within said chamber, said double-arm lever defining actuation members on said lower portion of said magazine retainer, said actuation members comprising a pair of spaced actuation plates disposed at the merging of said trigger guard and said pistol stock and each having an outer surface flush with the surface of said firearm such that the direction of motion of said actuation plates for unlocking the magazine is aligned obliquely downward and to the rear.

2. A magazine retainer as claimed in claim 1 wherein said first recess is formed during injection molding of the pistol stock.

3. A magazine retainer as claimed in claim 1 wherein said axis comprises a bearing pin, said bearing pin is molded to said magazine retainer and being received by a snap connection into correspondingly shaped notches in said pistol stock.

4. A magazine retainer as claimed in claim 3 wherein said pistol stock is molded from a plastic and said magazine retainer is molded to said pistol stock.

* * * * *